US010600585B2

(12) United States Patent
Huebner et al.

(10) Patent No.: US 10,600,585 B2
(45) Date of Patent: Mar. 24, 2020

(54) GEAR UNIT HOUSING COVER INTERCONNECT WITHIN A CIRCUIT BREAKER

(71) Applicant: SIEMENS AKTIENGESELLSCHAFT, Munich (DE)

(72) Inventors: Sebastian Huebner, Berlin (DE); Martin Krehnke, Berlin (DE); Andrzej Nowakowski, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/322,596

(22) PCT Filed: Jul. 6, 2017

(86) PCT No.: PCT/EP2017/066991
§ 371 (c)(1),
(2) Date: Feb. 1, 2019

(87) PCT Pub. No.: WO2018/024433
PCT Pub. Date: Feb. 8, 2018

(65) Prior Publication Data

US 2019/0180952 A1 Jun. 13, 2019

(30) Foreign Application Priority Data

Aug. 2, 2016 (DE) ..... 10 2016 214 221

(51) Int. Cl.
*H01H 33/42* (2006.01)
*H01H 33/02* (2006.01)
(Continued)

(52) U.S. Cl.
CPC ..... *H01H 9/02* (2013.01); *H01H 3/42* (2013.01); *H01H 3/46* (2013.01); *H01H 33/42* (2013.01);
(Continued)

(58) Field of Classification Search
CPC ..... H01H 33/42; H01H 33/46; H01H 33/48; H01H 2033/028; H01H 3/42; H01H 3/46
See application file for complete search history.

(56) References Cited

U.S. PATENT DOCUMENTS 6,177,643 B1 * 1/2001 Marin ..... H01H 33/245 218/154
6,271,494 B1 * 8/2001 Dienemann ..... H01H 33/245 218/48
(Continued)

FOREIGN PATENT DOCUMENTS

CN 102927110 A 2/2013
CN 203362785 U 12/2013
(Continued)

OTHER PUBLICATIONS

Martin Krehnke, et al. "Verbesserte Lagerung and Führung eines Pins" Siemens AG 2013; file: 6543664.doc, 2 pages.

*Primary Examiner* — Vanessa Girardi
(74) *Attorney, Agent, or Firm* — Laurence Greenberg; Werner Stemer; Ralph Locher

(57) ABSTRACT

A gear unit housing for a gear unit includes a two-sided control lever for moving two switching contacts of a circuit breaker in opposite directions. The gear unit housing includes a housing cassette having a housing base and a cover plate detachably connected to the housing cassette by screw connections and lying opposite to the housing base. A bearing shaft for mounting the control lever for rotation about the bearing shaft is connected to the housing cassette and to the cover plate and extends between the housing base
(Continued)

and the cover plate. At least one stud element form-lockingly connects the housing cassette and the cover plate. A gear unit having the gear unit housing is also provided.

14 Claims, 2 Drawing Sheets

(51) Int. Cl.

| | |
|---|---|
| ***H01H 9/02*** | (2006.01) |
| ***H01H 3/46*** | (2006.01) |
| ***H01H 3/42*** | (2006.01) |
| *H01H 3/32* | (2006.01) |

(52) U.S. Cl.
CPC . *H01H 2003/326* (2013.01); *H01H 2033/028* (2013.01)

(56) References Cited

U.S. PATENT DOCUMENTS

| | | | | |
|---|---|---|---|---|
| 6,365,863 | B1 | 4/2002 | Marin et al. | |
| 8,415,578 | B2 * | 4/2013 | Hunger | H01H 33/904 218/154 |
| 9,484,161 | B2 * | 11/2016 | Gericke | H01H 33/245 |
| 9,633,806 | B2 * | 4/2017 | Krehnke | H01H 33/42 |
| 9,748,059 | B2 * | 8/2017 | Cernat | H01H 33/123 |
| 10,199,188 | B2 * | 2/2019 | Terada | H01H 33/42 |
| 2016/0203927 | A1 | 6/2016 | Terada et al. | |

FOREIGN PATENT DOCUMENTS

| | | | |
|---|---|---|---|
| CN | 204205779 | U | 3/2015 |
| CN | 204279473 | U | 4/2015 |
| CN | 105221522 | A | 1/2016 |
| DE | 19738697 | C1 | 11/1998 |
| WO | 2014001160 | A1 | 1/2014 |

* cited by examiner

GEAR UNIT HOUSING COVER INTERCONNECT WITHIN A CIRCUIT BREAKER

BACKGROUND OF THE INVENTION

Field of the Invention

The invention relates to a gear unit for moving two switch contacts of a circuit breaker in opposite directions to one another.

As the voltage level increases, the relative contact speed of the switch contacts that is required in a circuit breaker increases. In the case of high voltage levels, the required relative contact speed is therefore often achieved by means of moving the switch contacts in opposite directions to one another. In this case, the movement of the switch contacts is achieved by way of example by means of a gear unit by means of which the switch contacts are moved simultaneously in opposite directions to one another. As the contact speed increases, the loading on the mechanical components in the gear unit increases. High loadings may damage or even destroy components in the gear unit and as a result jeopardize the continuous switching ability of the circuit breaker.

SUMMARY OF THE INVENTION

The object of the invention is to provide a gear unit that is improved, in particular with respect to the loading in the case of high contact speeds, for moving two switch contacts of a circuit breaker in opposite directions to one another.

The object is achieved in accordance with the invention by a gear unit housing for a gear unit having a two-sided control lever for moving two switch contacts of a circuit breaker in opposite directions to one another, the gear unit housing comprising a housing cassette with a housing base, a cover plate that is connected in a detachable manner to the housing cassette by screw connections and lies opposite the housing base, a bearing shaft that is connected to the housing cassette and the cover plate and extends between the housing base and the cover plate for mounting the control lever in such a manner that the control lever is able to rotate about the bearing shaft, and at least one stud element that connects the housing cassette and the cover plate in a form-locking manner. The object is also achieved by a gear unit for moving two switch contacts of a circuit breaker in opposite directions to one another, the gear unit comprising a gear unit housing in accordance with the invention and a two-sided control lever that is disposed in the gear unit housing, the control lever having a first lever side, which is connected to a first switch contact, and a second lever side, which is connected to the second switch contact, wherein the control lever has a cut-out and the bearing shaft of the gear unit housing is guided through the lever cut-out, so that the control lever is mounted so as to be able to rotate about the bearing shaft.

Advantageous embodiments of the invention are the subject matter of the subordinate claims.

A gear unit housing in accordance with the invention for a gear unit having a two-sided control lever for moving two switch contacts of a circuit breaker in opposite directions to one another comprises a housing cassette with a housing base, a cover plate, a bearing shaft for mounting the control lever in such a manner that said control lever is able to rotate about the bearing shaft, and at least one stud element. The cover plate is connected in a detachable manner to the housing cassette by means of screw connections and said cover plate lies opposite the housing base. The bearing shaft is connected to the housing cassette and the cover plate and extends between the housing base and the cover plate. Each stud element connects the housing cassette and the cover plate in a form-locking manner.

The gear unit housing thus provides at least one stud element that in addition to force-locking screw connections connects the housing cassette and the cover plate in a form-locking manner. This form-locking connection absorbs transverse forces that are exerted on the cover plate in the plane of the cover plate via the bearing shaft as the control lever rotates. As a result, the form-locking connection of the cover plate to the housing cassette reduces the loading on the screw connections, said form-locking connection being produced by means of the at least one stud element. Without such a reduction of the loading, high transverse forces may reduce the extent to which the screws are tensioned in the screw connections and the screw connections may become loose with the result that the cover plate may displace relative to the housing cassette. This also destabilizes the bearing shaft and may lead to said bearing shaft becoming damaged or even destroyed, as a result of which the functionability of the gear unit may be impaired or destroyed. In the case of the gear unit housing in accordance with the invention, high loadings on the screw connections as a result of high transverse forces in the case of high contact speeds of the switch contacts are therefore avoided, in that transverse forces are compensated by means of the form-locking connection of the cover plate to the housing cassette by means of at least one stud element.

One embodiment of the invention provides that each stud element extends parallel to the longitudinal axis. This embodiment of the invention renders it possible for the transverse forces to be absorbed in a particularly efficient manner by virtue of arranging the stud elements parallel to the bearing shaft, said transverse forces being transmitted along said bearing shaft.

A further embodiment of the invention provides that at least one stud element is configured as one piece with the housing cassette, and that the cover plate comprises a cut-out that corresponds to the stud element and the stud element protrudes into said cover cut-out. This embodiment of the invention renders it possible to connect the housing cassette and the cover plate in a particularly stable form-locking manner by virtue of designing the stud elements as part of the housing cassette.

A further embodiment of the invention provides that at least one stud element is configured as one piece with the cover plate, and that the housing cassette comprises a cut-out that corresponds to the stud element and the stud element protrudes into said cassette cut-out. This embodiment of the invention renders it possible to connect the housing cassette and the cover plate in a particularly stable form-locking manner by virtue of designing the stud elements as part of the cover plate.

A further embodiment of the invention provides that at least one stud element is configured as a pin element, by way of example as a tensioning pin that is guided through a cut-out in the cover plate into a cut-out in the housing cassette. As an alternative or in addition thereto, at least one stud element may be configured as a fitting screw with an outer thread, said fitting screw being guided through a cut-out in the cover plate and screwed into a cut-out in the housing cassette that has an inner thread that corresponds to the outer thread of the fitting screw. These embodiments of the invention render it possible to arrange the stud elements in a flexible manner in particular as required by virtue of said stud elements being designed as pin elements or/and fitting screws. By designing a stud element as a tensioning pin or as a fitting screw, it is in so doing rendered possible to fix the stud element in the housing cassette in a simple and reliable manner.

A further embodiment of the invention provides that the bearing shaft is configured as one piece with the housing cassette and that the cover plate comprises a cut-out that corresponds to the bearing shaft and the bearing shaft protrudes into said cover cut-out. As an alternative thereto, the bearing shaft may be configured as one piece with the cover plate, and the housing cassette may comprise a cut-out that corresponds to the bearing shaft and the bearing shaft protrudes into said cassette cut-out. Both embodiments of the invention render it possible for the bearing shaft to be mounted in a particularly stable manner as part of the housing cassette or rather as part of the cover plate.

A gear unit in accordance with the invention for moving two switch contacts of a circuit breaker in opposite directions to one another comprises a gear unit housing in accordance with the invention and a two-sided control lever that is arranged in the gear unit housing. A first lever side of the control lever is connected to a first switch contact and the second lever side is connected to the second switch contact. The control lever comprises a cut-out and the bearing shaft of the gear unit housing is guided through said lever cut-out, with the result that the control lever is mounted so as to be able to rotate about the bearing shaft. The advantages of the gear unit arise from the advantages already described above of the gear unit housing.

The first lever side of the control lever is connected to the first switch contact by way of example via a drive rod that protrudes into the gear unit housing. In so doing, the first lever side comprises by way of example at least one coupling lug, and a control lever side end region of the drive rod comprises for each coupling lug an oblong hole and the coupling lug is guided in said oblong hole. Rotational movements of the control lever are transmitted to the first switch contact by means of the drive rod. By virtue of connecting the control lever to the drive rod via at least one coupling lug of the control lever, said coupling lug being guided in an oblong hole of the drive rod, it is possible to convert the rotational movements of the control lever into translations of the drive rod.

The second lever side of the control lever is connected by way of example to the second switch contact via a stud, wherein the stud is guided in a guide rail that protrudes into the gear unit housing and the second lever side protrudes into said guide rail. The guide rail together with the stud renders it possible to convert translatory movements of the second switch contact via the stud into rotational movements of the control lever as a result of the stud making contact with the second lever side that protrudes into the guide rail.

A circuit breaker in accordance with the invention comprises a gear unit in accordance with the invention. The advantages of the circuit breaker arise from the advantages already mentioned above of the gear unit housing and the gear unit.

The above described characteristics, features and advantages of this invention and also the manner in which these are achieved become clearer and more easily understandable in conjunction with the following description of the exemplary embodiments that are explained in detail with reference to the drawings.

DESCRIPTION OF THE INVENTION

Figure 1:
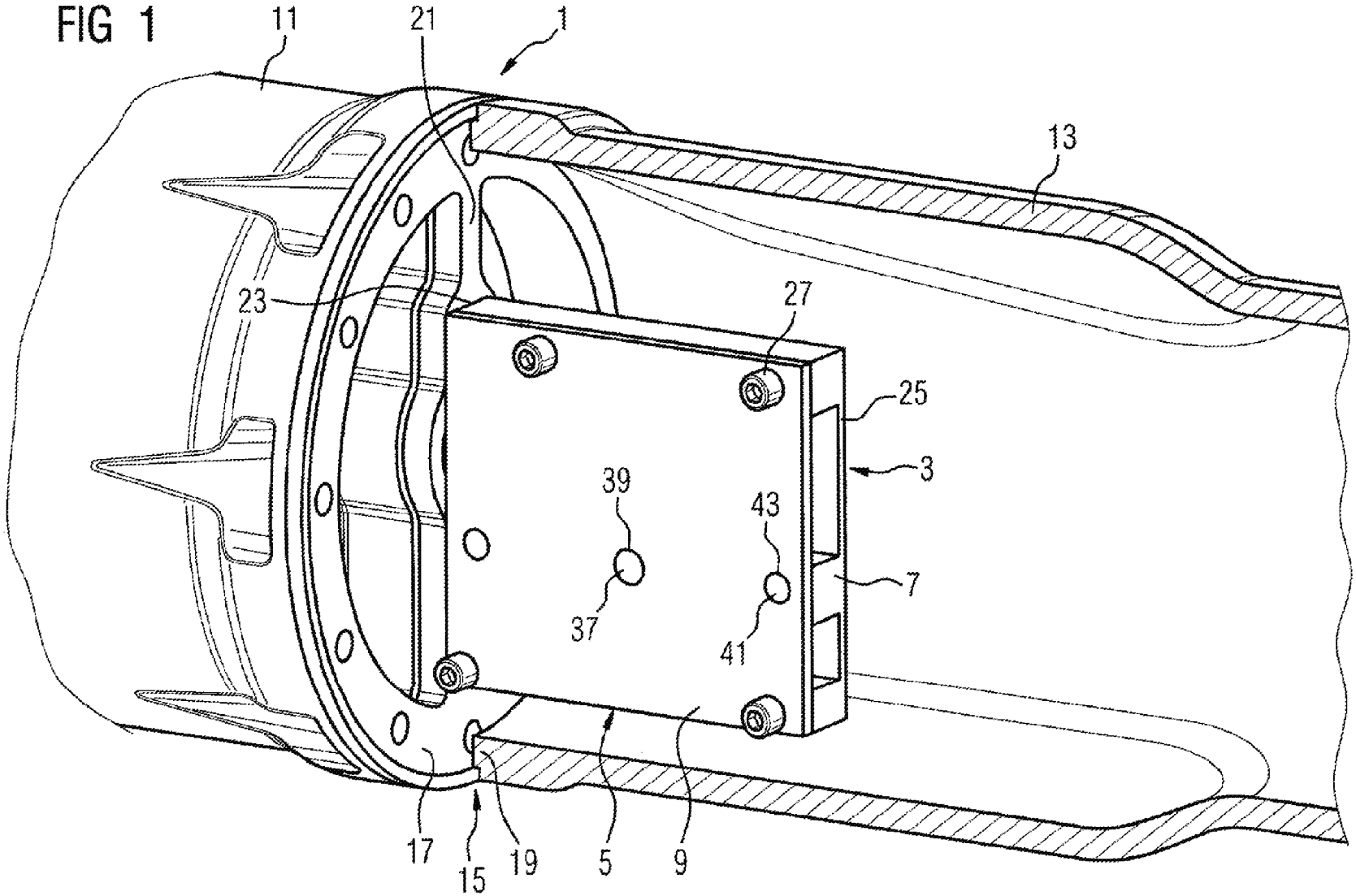
FIG. 1 illustrates a circuit breaker in the region of a gear unit with a gear unit housing.

Parts that correspond with one another are provided in the figures with like reference numerals.

Figure 2:
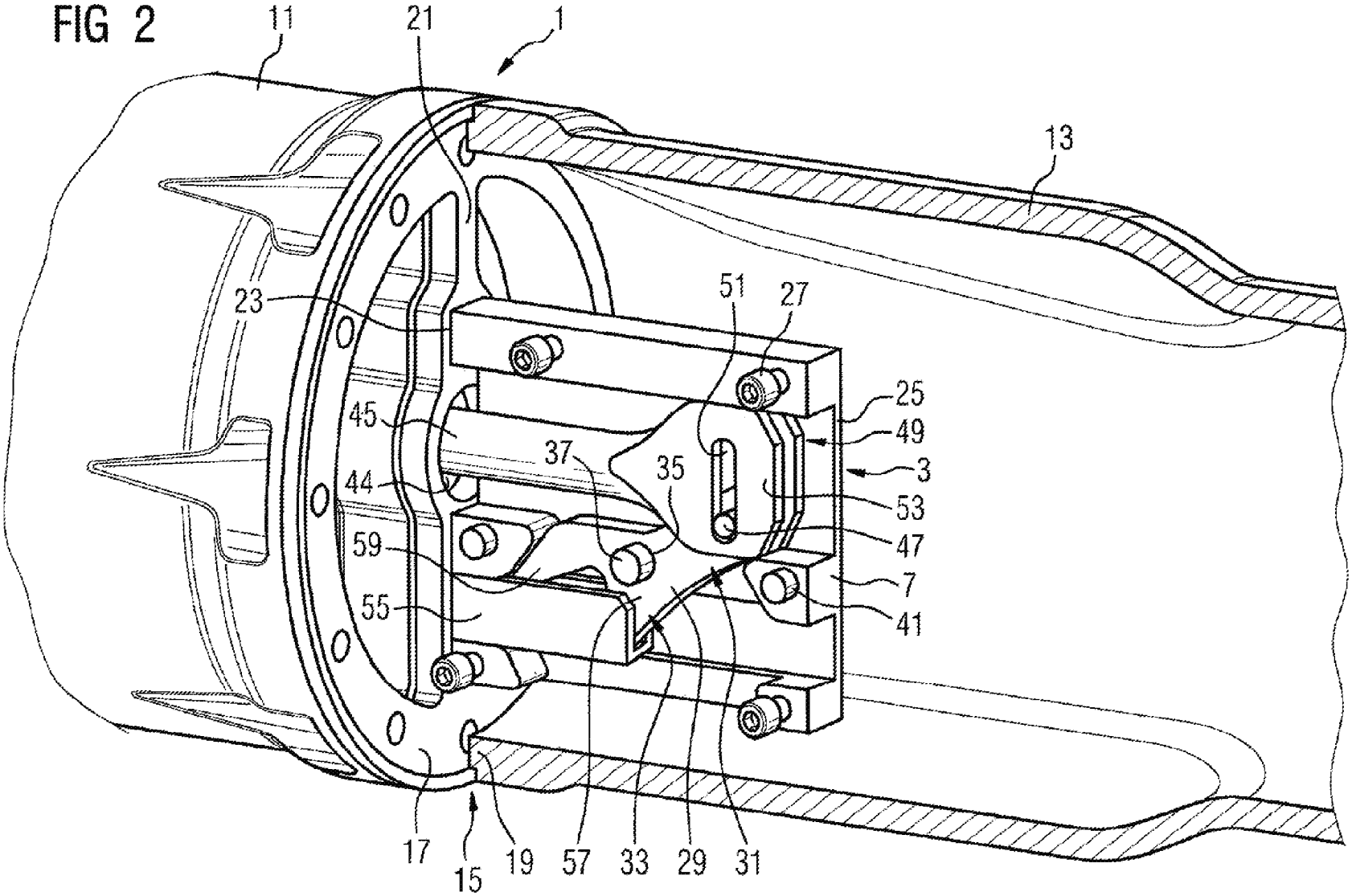
FIG. 2 illustrates the region of a circuit breaker that is illustrated in FIG. 1 in this case without the cover plate of the gear unit housing.

FIGS. 1 and 2 illustrate a circuit breaker 1 in the region of a gear unit 3 of the circuit breaker 1 in each case in a perspective view. The gear unit 3 comprises a gear unit housing 5 having a housing cassette 7 and a cover plate 9. FIG. 1 illustrates the gear unit housing 5 with the cover plate 9. FIG. 2 illustrates the gear unit housing 5 without the cover plate 9.

The gear unit 3 is configured for moving two switch contacts of the circuit breaker 1 in opposite directions to one another. The switch contacts are arranged in a first housing part 11 of the circuit breaker 1 and are not visible in FIGS. 1 and 2. The first housing part 11 is connected to a second housing part 13 of the circuit breaker 1 via a flange connection 15. The flange connection 15 is formed by a first flange 17 of the first housing part 11 and a second flange 19 that corresponds thereto and is part of the second housing part 13. Two diametrically opposite flange regions of the first flange 17 are connected to one another by means of a middle web 21. The second housing part 13 is illustrated in a broken-open view in order to make the gear unit 3 visible.

One end face 23 of the housing cassette 7 is fastened to the middle web 21 by means of fastening screw connections that are not visible in FIGS. 1 and 2. The housing cassette 7 protrudes from the middle web 21 into the second housing part 13 and comprises a housing base 25 that protrudes in a perpendicular manner from the middle web 21. The cover plate 9 of the gear unit housing 5 is connected in a detachable manner to the housing cassette 7 by means of screw connections 27 and lies opposite the housing base 25.

In order to move the switch contacts in opposite directions to one another, the gear unit 3 comprises a two-sided control lever 29 that is arranged in the gear unit housing 5. A first lever side 31 of the control lever 29 is connected to a first switch contact. A second lever side 33 that is lying opposite the first lever side 31 is connected to the second switch contact. The control lever 29 comprises a cut-out 35 and a bearing shaft 37 of the gear unit housing 5 is guided through said lever cut-out, with the result that the control lever 29 is mounted so as to be able to rotate about the bearing shaft 37.

The bearing shaft 37 is part of the housing cassette 7, in other words is configured as one piece with the housing cassette 7. The cover plate 9 comprises a first cut-out 39 that corresponds to the bearing shaft 37 and the bearing shaft 37 protrudes through said first cover cut-out. The first cover cut-out 39 is configured as a through-going hole in the cover plate 9.

The gear unit housing 5 comprises moreover two stud elements 41 that are parts of the housing cassette 7, in other words are configured as one piece with the housing cassette 7 and extend parallel to the bearing shaft 37 toward the cover plate 9. The cover plate 9 comprises for each stud element 41 a second cut-out that corresponds to the stud element 41 and the stud element 43 protrudes through said second 43 cut-out. Each second cover cut-out 43 is configured as a through-going hole in the cover plate 9. The housing cassette 7 and the cover plate 9 are connected to one another in a form-locking manner by means of the stud elements 41 that are protruding into the second cover cut-outs 43. The form-locking connection absorbs transverse forces that are exerted on the cover plate 9 in the plane of the cover plate 9 via the bearing shaft 37 as the control lever 29 rotates. As a result, the form-locking connection between the cover plate 9 and the housing cassette 7 that is produced by means of the stud elements 41 reduces the loading on the screw connections 27 with the result that a reduction of the tensioning of the screws in the screw connections 27 caused by high transverse forces is prevented, as is a resultant movement of the cover plate 9 relative to the housing cassette 7.

In order to connect the first lever side 31 to the first switch contact, the first lever side 31 is connected to the first switch contact via a drive rod 45 that protrudes through a first cut-out 44 in the middle web 21 into the gear unit housing 5. For this purpose, the first lever side 31 comprises two coupling lugs 47, and a control lever-side end region 49 of the drive rod 45 comprises for each coupling lug 47 an oblong hole 51 and the coupling lug 47 is guided in said oblong hole. The end region 49 of the drive rod 45 comprises two end plates 53 that are arranged spaced apart and parallel to one another and that each comprise one of the oblong holes 51. The first lever side 31 protrudes into the region between the two end plates 53. The coupling lugs 47 are located on opposite sides of the first lever side 31 and protrude from the first lever side 31 in each case toward the end plate 53 that is arranged at that site, with the result that said coupling lugs protrude into the oblong hole 51 of this end plate 53.

The second lever side 33 is connected to the second switch contact via a stud that is not visible in FIGS. 1 and 2. The stud is guided in a guide rail 55, which protrudes into the gear unit housing 5, through a second cut-out in the middle web 21, said second cut-out not being visible in FIGS. 1 and 2. The second lever side 33 protrudes into the guide rail 55 and is configured in the shape of a fork with two tines 57, 59 and the stud is inserted between said tines. A movement of the stud in a direction that faces away from the first housing part 11 toward the second housing part 13 causes the control lever 29 to rotate and said control lever moves the drive rod 45 in the opposite direction via the coupling lugs 47. The stud is driven together with the second switch contact by way of example by means of a drive, not illustrated, of the circuit breaker 1. The gear unit 3 moves the first switch contact in the opposite direction to the second switch contact.

An alternative exemplary embodiment to the exemplary embodiment illustrated in FIGS. 1 and 2 provides that the stud elements 41 are not configured as one piece with the housing cassette 7 but rather are configured as one piece with the cover plate 9 and protrude in a form-locking manner into the cut-outs in the housing cassette 7, said cassette cut-outs corresponding to said stud elements. In further exemplary embodiments, the stud elements 41 are neither configured as one piece with the housing cassette 7 nor with the cover plate 9 but rather are configured as pin elements, by way of example as tensioning pins, or as fitting screws, which are guided through second cut-outs 43 in the cover plate 9 into cut-outs in the housing cassette 7 and are fixed therein. In further exemplary embodiments, the bearing shaft 37 is not configured as one piece with the housing cassette 7 but rather is configured as one piece with the cover plate 9 and protrudes into a cut-out in the housing cassette 7, said cassette cut-out corresponding to the bearing shaft 37, or the bearing shaft 37 is neither configured as one piece with the housing cassette 7 nor as one piece with the cover plate 9 but rather is configured as a shaft element that connects to the housing cassette 7 and the cover plate 9 and is by way of example a stud. The cassette cut-outs may be configured in the said exemplary embodiments in each case a through-going holes or as blind holes. Moreover, if there is sufficient thickness in the cover plate 9, the first cover cut-out 39 and/or the second cover cut-outs 43 of the exemplary embodiment illustrated in FIGS. 1 and 2 may be configured as blind holes in lieu of through-going holes.

Although the invention is further illustrated and described in detail with reference to preferred exemplary embodiments, the invention is however not limited by the disclosed examples and other variations may be derived therefrom by the person skilled in the art without departing from the protection scope of the invention.

The invention claimed is:

1. A gear unit housing for a gear unit having a two-sided control lever for moving two switch contacts of a circuit breaker in mutually opposite directions, the gear unit housing comprising:

a housing cassette having a housing base;

a cover plate lying opposite to said housing base;

screw connections detachably interconnecting said cover plate and said housing cassette;

a bearing shaft connected to said housing cassette and to said cover plate, said bearing shaft extending between said housing base and said cover plate for mounting the control lever rotatably about said bearing shaft; and at least one stud element form-lockingly interconnecting said housing cassette and said cover plate.

2. The gear unit housing according to claim 1, wherein said at least one stud element extends parallel to said bearing shaft.

3. The gear unit housing according to claim 1, wherein said at least one stud element is formed in one piece with said housing cassette, said cover plate has a cover plate cut-out corresponding to said at least one stud element, and said stud element protrudes into said cover plate cut-out.

4. The gear unit housing according to claim 1, wherein said at least one stud element is formed in one piece with said cover plate, said housing cassette has a cassette cut-out corresponding to said at least one stud element, and said stud element protrudes into said cassette cut-out.

5. The gear unit housing according to claim 1, wherein said at least one stud element is a fitting screw having an outer thread, being guided through a cut-out in said cover plate, and being screwed into a cut-out in said housing cassette having an inner thread corresponding to said outer thread of said fitting screw.

6. The gear unit housing according to claim 1, wherein said bearing shaft is formed in one piece with said housing cassette, said cover plate has a cover plate cut-out corresponding to said bearing shaft, and said bearing shaft protrudes into said cover plate cut-out.

7. The gear unit housing according to claim 1, wherein said bearing shaft is formed in one piece with said cover plate, said housing cassette has a cassette cut-out corresponding to said bearing shaft, and said bearing shaft protrudes into said cassette cut-out.

8. The gear unit housing according to claim 1, wherein said at least one stud element is a pin element guided through a cut-out in said cover plate into a cut-out in said housing cassette.

9. The gear unit housing according to claim 8, wherein said at least one pin element is a tensioning pin.

10. A gear unit for moving first and second switch contacts of a circuit breaker in mutually opposite directions, the gear unit comprising:

a gear unit housing according to claim 1;

a two-sided control lever disposed in said gear unit housing, said control lever having a first lever side connected to the first switch contact and a second lever side connected to the second switch contact, and said control lever having a lever cut-out formed therein; and said bearing shaft of said gear unit housing being guided through said lever cut-out for mounting said control lever rotatably about said bearing shaft.

11. The gear unit according to claim 10, which further comprises a guide rail protruding into said gear unit housing, and a stud interconnecting said second lever side and the second switch contact, said stud being guided in said guide rail, and said second lever side protruding into said guide rail.

12. A circuit breaker, comprising a gear unit according to claim 10.

13. The gear unit according to claim 10, which further comprises a drive rod interconnecting said first lever side and the first switch contact, said drive rod protruding into said gear unit housing.

14. The gear unit according to claim 13, wherein said first lever side has at least one coupling lug, said drive rod has a control lever-side end region with an oblong hole formed therein, and said at least one coupling lug is guided in said oblong hole.

* * * * *